US006098911A

United States Patent [19]

Sheldon

[11] Patent Number: 6,098,911

[45] Date of Patent: Aug. 8, 2000

[54] PORTABLE FILAMENT DISPENSER

[76] Inventor: Bradley Sheldon, 4189 Grove Ave., Gurnee, Ill. 60031

[21] Appl. No.: 09/263,546

[22] Filed: Mar. 8, 1999

[51] Int. Cl.[7] ..... B65H 49/20; B65H 59/04; B21C 47/18

[52] U.S. Cl. ..... 242/423.1; 242/442; 242/588.6

[58] Field of Search ..... 242/423.1, 423.2, 242/396.7, 588.6, 129, 129.8, 588.1, 588.2, 588.3, 396.8, 381.6, 156, 137.1, 442

[56] References Cited

U.S. PATENT DOCUMENTS

| | | | |
|---|---|---|---|
| 724,652 | 4/1903 | Babb | 242/423.1 |
| 2,463,303 | 3/1949 | Petrie | 242/381.6 |
| 2,479,710 | 8/1949 | Arnold | 242/156 |
| 2,504,563 | 4/1950 | Menke | 242/396.8 |
| 2,517,866 | 8/1950 | Glahn | 242/156 |
| 3,021,094 | 2/1962 | Waranch | 242/137.1 |
| 3,090,577 | 5/1963 | Lewandowski | 242/396.8 |
| 3,502,281 | 3/1970 | McLain | 242/137.1 |
| 3,612,427 | 10/1971 | Bishop | 242/137.1 |
| 3,942,736 | 3/1976 | Ramos | 242/423.1 |
| 4,418,875 | 12/1983 | Brine | 242/442 |
| 4,522,349 | 6/1985 | Clerk | 242/396.7 |
| 4,765,557 | 8/1988 | Kahmann | 242/381.6 |
| 4,998,685 | 3/1991 | Spencer | 242/137.1 |
| 5,062,580 | 11/1991 | Meagher | 242/125.2 |
| 5,424,540 | 6/1995 | Garcia et al. . | |
| 5,672,871 | 9/1997 | Jacobs et al. . | |

*Primary Examiner*—John M. Jillions
*Attorney, Agent, or Firm*—Patnaude & Videbeck

[57] ABSTRACT

A portable filament dispenser made of clear polycarbonate includes two hollow clam shell-like halves that are complementarily mated together. A spool of fine wire filament is rotatably positioned on a spindle in the hollow interior of the dispenser. The filament passes through a wiper near the front of the dispenser and exits through an orifice at the distal end of a hollow cone. The filament spool is sandwiched between two felt pads and positioned below a freely depressible button mounted through an aperture in the top clam shell half. As the filament is wound out through the orifice in the cone, the pressure of a single digit, i.e., a thumb, will maintain the filament at a desired tension while winding same between posts or around posts in a grid.

8 Claims, 2 Drawing Sheets

PORTABLE FILAMENT DISPENSER

This invention relates to portable manually operated filament dispensers and more particularly, to a filament dispenser for mounting replacement corona wires on computer printers, electronic copiers and the like.

BACKGROUND OF THE INVENTION

Corona wires are utilized to generate a static electric charge to attract and repel toner from paper and to control the direction of travel of paper passing through personal computer printers and xerographic copiers. The heat generated in the toner fusion process and the harsh chemical environment in the machine eventually degrades the wires and they must be replaced if they are to adequately perform their job. Corona wires are mounted on removable frames and in various recyclable cartridges used in laser printers and copiers. As the cartridges are recycled, the corona wire will be replaced, if necessary. In certain instances, the corona wire is stretched between two rivets inserted in hollow plastic posts on the cartridge. In other cases, the corona wire is strung around a grid of such posts. In either case, once the distal end of the corona wire is fastened to a mounting post, it must be kept taught as it is strung across the space between mounting posts or as it is strung around various posts on a grid.

Various means of dispensing wire filaments have been developed. U.S. Pat. No. 5,062,580 discloses a spool with a resilient tab for storing and dispensing filament material. U.S. Pat. No. 5,672,871 discloses a corona wire handling device. U.S. Pat. No. 5,424,540 discloses a corona charger wire tensioning mechanism. U.S. Pat. No. 3,612,427 discloses a filament dispenser. A filament dispenser made of plastic includes a generally hollow cylindrical housing having a closed base on one end of the cylindrical housing and an open top on the other. The hollow cylindrical housing is sized sufficient to put a spool of filament therein, and a central threaded mounting post extends through the bottom wall of the housing, through the open central bore of the spool, and includes a threaded thumb screw on top of the spool. Filamentary wire from the spool is extended outwardly of the dispenser through a circular aperture in the cylindrical side wall. A hollow conical dispensing nozzle provides an exit for the filament. While the filament dispenser may be held in the palm or fingers of a user, both the thumb and first index finger are needed to turn the thumb screw to put pressure on the spool in order to maintain tension on the corona wire. The use of a single digit to turn the thumbscrew is unstable. The need for the use of multiple digits to operate the thumb screw degrades optimum usability of the filament dispenser.

A need has developed for an improved filament dispenser which may be more easily and simply manipulated by a user to string filament between a pair of poles, or around multiple poles in a grid while maintaining tension on the filament wire.

BRIEF DESCRIPTION OF THE DRAWINGS

The features of the present invention which are believed to be novel are set forth with particularity in the appended claims. The invention, together with further objects and advantages thereof may best be understood by reference to the following description taken in connection with the accompanying drawings, wherein like reference numerals identify like elements throughout, and in which:

DETAILED DESCRIPTION OF THE PREFERRED EMBODIMENTS

Figure 1:
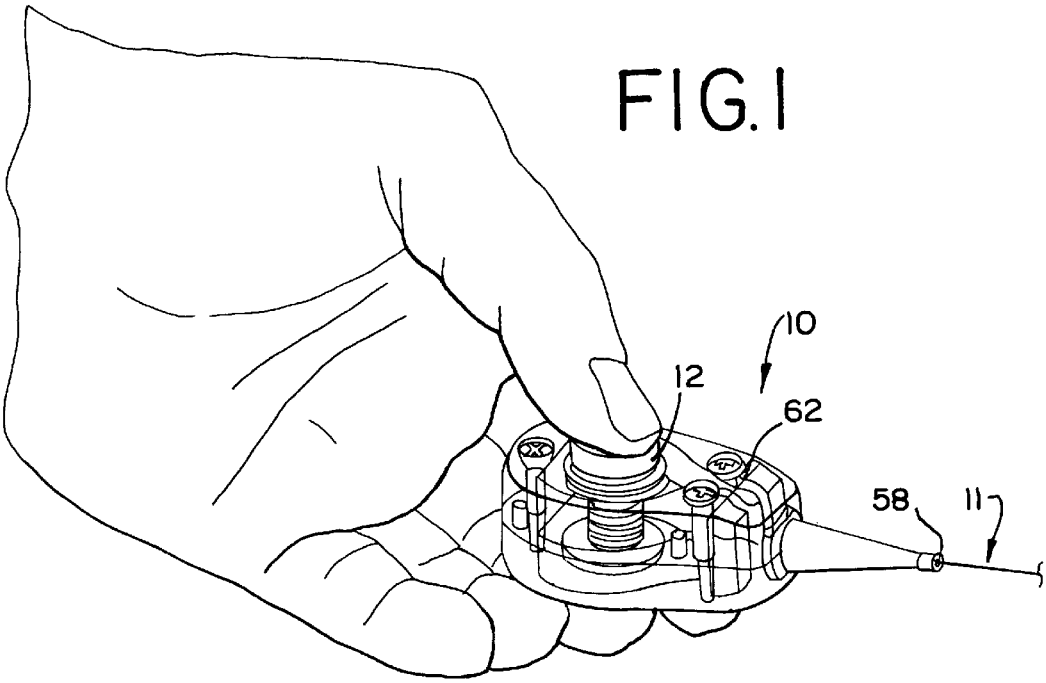
FIG. 1 is a perspective view of a filament dispenser constructed in accordance with the present invention, shown being manually manipulated by a user.

Referring to FIG. 1, a portable filament dispenser, generally indicated at 10, constructed in accordance with the present invention is shown cradled in the left hand of a user and is being operated in a manner to keep the filament, generally indicated at 11, extending outwardly of the dispenser in a properly taut condition. In use, the dispenser 10 is cradled in the fingers of a user on the bottom of the dispenser with a thumb pressing on a drag button 12 positioned in the top of the dispenser. The drag button provides infinitely adjustable tension with the use of a single digit of the user's hand. The operation of the drag button 12 and the dispenser 10 will be discussed in more detail below.

Referring to FIGS. 2, 3, 4 and 5, filament dispenser 10 includes a generally tear drop shaped housing which is truncated at its narrow end, and provides a hollow interior created by mating a hollow lower shell 13 and a hollow upper shell 14. Clam shell halves 13 and 14 are preferably made of molded clear polycarbonate. Bottom half shell 13 includes a generally flat bottom surface 15 and a curved side wall 16 having a semicircular back end shaped similarly to the rounded back end of a guitar or violin. The front portion of the side wall 16 includes two converging side wall sections 16*a* and 16*b* which end in a relatively flat face 17. The bottom includes a flat surface 15 and an upwardly extending generally trapezoidal surface 18 between that bottom surface and the face 17 of the bottom clam shell 13.

The top clam shell 14 is shaped substantially complementary to the bottom clam shell 13 and includes the tear drop semicircular shaped side wall back end 20 and front opposing converging portions 21*a*, 21*b* which end in the flat upper face 22. The generally flat upper surface 23 of half clam shell 14 has extending from its front boundary a generally downwardly sloping trapezoidal surface 24 which ends at the upper boundary of front face 22. A parting line 25*a*, 26*a* joins the bottom claim shell 13 to the top clam shell 14.

Figure 7:
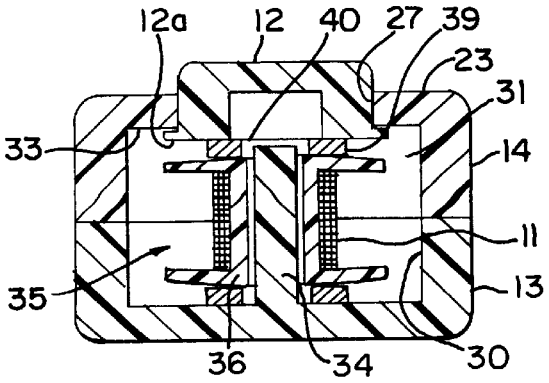
FIG. 7 is a cross-sectional view taken substantially along lines 7—7 of FIG. 3.

Referring to FIG. 7, the top surface 23 of upper clam shell 14 includes a circular bore 27 into which button 12 is slidably received. A shoulder 12*a* on the bottom of button 12 prevents the button from falling out of the filament dispenser 10 when it is mounted through bore 27.

Figure 6:
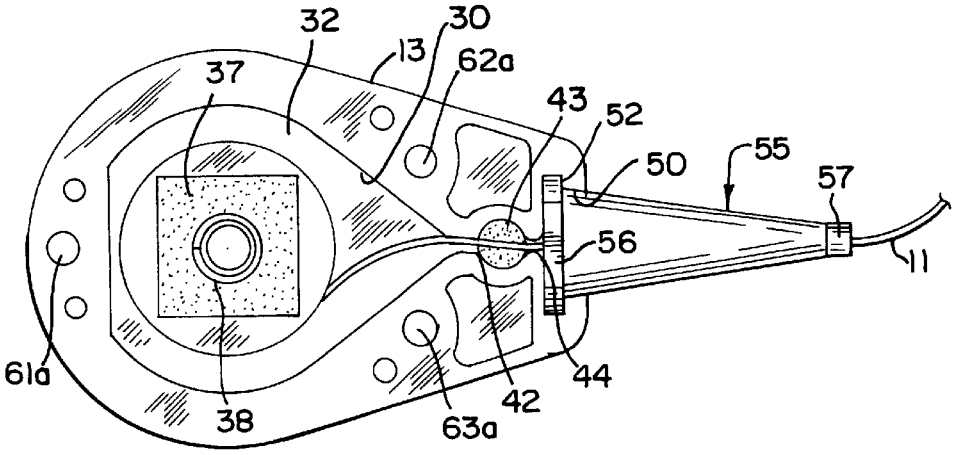
FIG. 6 is a top plan view of the filament dispenser similar to that shown in FIG. 2, with the top half of the housing removed showing the hollow interior thereof.

Referring to FIGS. 6 and 7, both the top and bottom claim shell halves 13 and 14 include generally tear drop shaped hollowed out portions having vertical side walls 30 and 31, respectively. Bottom claim shell half 13 includes a hollow generally flat bottom surface 32 and upper clam shell half 14 includes a hollow generally flat top surface 33. A generally cylindrical spool post 34 extends from the bottom surface 32 as shown most clearly in FIG. 7. The spool post 34 provides a spindle for a spool of thread, generally indicated at 35 which includes the spool 36 having filament 11 wound thereon. A preferred spool 36 is one used as a bobbin in Singer brand sewing machines. Referring to FIG. 6, a felt pad 37 having a circular aperture 38 therein is mounted on the spool post 34 at the bottom thereof prior to insertion of a spool 36 thereon. An additional felt pad 39 having a central aperture 40 thereon is positioned on top of spool 36 and sandwiched between the spool 36 and the bottom of button 12. At the front end of the hollow cavity defined by the bottom wall 32 as shown in FIG. 6, bottom clam shell housing includes a narrow passageway 42 which opens into a hollow cylindrical bulge in the passageway, designated 43. A felt pad 49 is positioned in the cylindrical bulge so as to wipe filament 11 as it passes therethrough. An additional narrow passageway 44 extends outwardly of the bottom clam shell 13. Upper clam shell 14 includes a complementary series of passageways shown in FIG. 2 with narrow passageway 46, semicylindrical bulging area 47 and narrow additional passageway 48 that mate with and extend those on clam shell 13.

Figure 2:
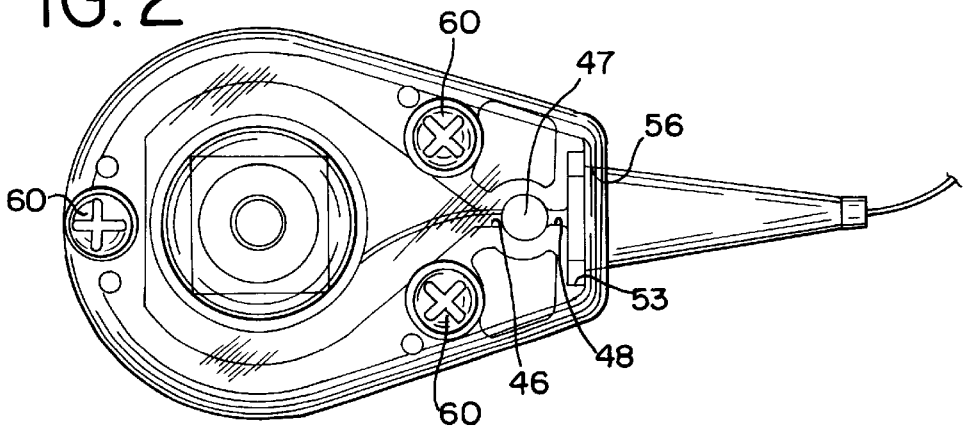
FIG. 2 is a top plan view of the filament dispenser shown in FIG. 1.
Figure 3:
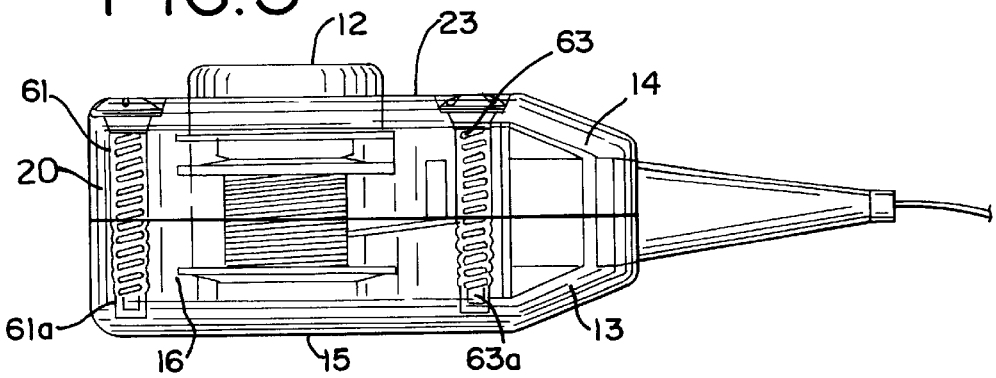
FIG. 3 is a side elevational view of the filament dispenser shown in FIG. 2.
Figure 4:
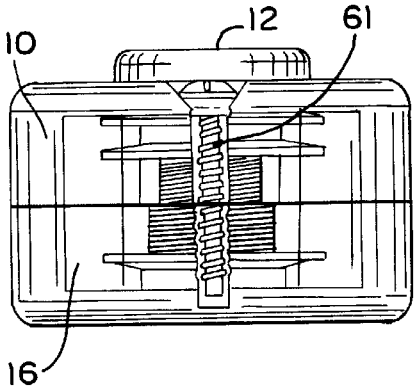
FIG. 4 is a back elevational view of the filament dispenser.
Figure 5:
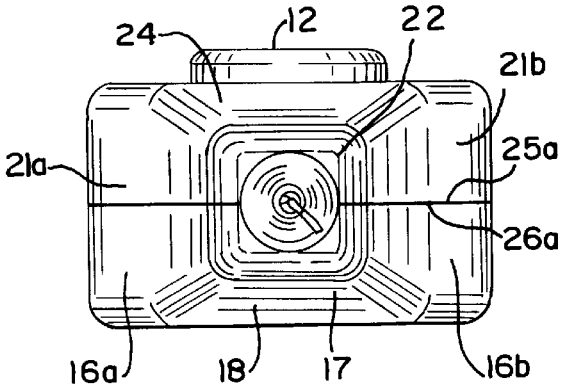
FIG. 5 is a front elevational view of the filament dispenser.

Referring to FIGS. 1, 2 and 6, the lower front face 17 and upper front face 22 include generally circular flanges 50, 51, respectively, which extend inwardly of the front faces to radially extending flange extensions 52, 53 which, in turn, meet the second passageways 44 and 48 in the bottom and top clam shells respectively. A dispensing cone, preferably made of plastic sold under the trademark DELRIN, generally indicated at 55, is hollow and includes a radially extending flange 56 at its back end which fits in the aperture 50, 51 and radial extensions 52, 53. The hollow DELRIN cone 55 has a converging conical body which ends at its distal end 57 with an orifice 58 through which the filament 11 extends. As shown most clearly in FIGS. 1–4, the two clam shell halves 13–14 are held together by phillips head screws 60—60 that extend through apertures 61, 61*a*, 62, 62*a* and 63, 63*a* in the respective top and bottom claim shell halves.

In operation

In order to operate the filament dispenser, the clam shell halves are separated by removing the screws 60—60. With the bottom felt pad 37 in place, a spool 36 is positioned on the spool post 34. The filament 11 off of the spool is threaded through the narrow passageways 42, 46, through the felt pad 49, through the second passageways 44, 53, then through the hollow interior of the DELRIN cone 55 and out the orifice 58 through the front thereof. A second felt pad 40 is positioned on the top of spool 36 and the upper clam shell half 14 including the button 12 is positioned thereover, and screws 60—60 are inserted into their respective mounting apertures.

In order to utilize the filament dispenser to replace corona wire in PC printer cartridges and xerographic copies, filament 11 would be mounted on a mounting post either through a bifurcated body of a rivet, or around a rivet. As shown in FIG. 1, the filament dispenser is pulled and the thumb of the user is depressed against the spool a sufficient amount to provide the proper tension on filament 11 as the filament is pulled out of the spool 36. The filament is pulled out of the spool either until the filament crosses a second mounting post wherein a rivet would be inserted to fix the filament, or the filament would be pulled out of the dispenser at the desired tension as the filament is wound around posts on a grid like frame until the last post of that frame is reached wherein the filament would be affixed to that post. The ability of the filament dispenser 10 to be utilized and the tension to be infinitely adjusted by only a single digit, i.e., the thumb of a user, provides an important improvement in the flexibility and usability of the filament dispenser of the present invention. By making the clam shell bodies out of clear plastic, the color of the filament 11 around the spool 36 may readily be seen to determine the size of that filament. It would most likely be appropriate for a technician, repairman or other user to have a series of these dispensers, each having a filament size and a defining color which would be usable for certain specific corona wire installations. It will be appreciated that the dispenser shown above may also be utilized for other filament mounting uses than described herein.

While one embodiment of the present invention has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A portable filament dispenser comprising:

a pair of complementary clam shell type half housings including a bottom shell and a top shell, said bottom shell including a generally flat bottom, a semicircular back wall and a pair of generally converging side walls, respectively, ending at the opposed sides of a flat front face, and a hollow interior, said top shell including a generally flat top, a semicylindrical back wall and a pair of generally converging side walls, respectively, ending at the opposed sides of a flat front face, and a hollow interior, said hollow interior of said bottom shell including a generally flat bottom surface and a first vertical side wall converging inwardly adjacent said bottom front face, a first narrow filament passageway between said converging portions of said first side wall and said bottom front face, said hollow interior of said top shell including a generally flat top surface and a second vertical side wall converging inwardly adjacent said top front face, a second narrow filament passageway between said converging portions of said second side wall and said top front face, a hollow dispensing cone mounted adjacent said top and bottom front face in communication with said first and second narrow filament passageways, said top shell including a bore between said flat top and said interior flat top surface, a button positioned in said bore for reciprocating movement therein and means for preventing the ejection of said button from said bore.

2. The filament dispenser as defined in claim 1, further including, a spindle extending from one of said button and said bottom interior surface of said bottom shell, a spool mounted for rotation on said spindle, and mean adjacent for infinitely adjusting the resistance to rotation of said spool.

3. The filament dispenser as defined in claim 1, wherein said complementary half shell housings are made of clear plastic.

4. The filament dispenser as defined in claim 2 wherein said means adjacent said spool include a felt pad positioned between said button and said spool.

5. A portable filament dispenser comprising:

a pair of complementary clam shell type half housings including a bottom shell and a top shell, a hollow interior of said bottom shell including a generally flat bottom surface and a first vertical side wall converging inwardly adjacent a bottom front face, a first narrow filament passageway between said converging portions of said first side wall and said bottom front face, a hollow interior of said top shell including a generally flat top surface and a second vertical side wall converging inwardly adjacent a top front face, a second narrow filament passageway between said converging portions of said second side wall and said top front face, a hollow dispensing cone mounted adjacent said top and bottom front face in communication with said first and second narrow filament passageways, said top shell including a bore between said flat top and said interior flat top surface, a button positioned in said bore for reciprocating movement therein and means for preventing the ejection of said button from said bore.

6. The filament dispenser as defined in claim 5 further including, a spindle extending from one of said button and said bottom interior surface of said bottom shell, a spool mounted for rotation on said spindle, and means adjacent said spool for infinitely adjusting the resistance to rotation of said spool.

7. The filament dispenser as defined in claim 5 wherein said complementary half shell housings are made of clear plastic.

8. The filament dispenser as defined in claim 6 wherein said means adjacent said spool include a felt pad positioned between said button and said spool.

* * * * *